US010791592B2

(12) United States Patent
Shoup et al.

(10) Patent No.: US 10,791,592 B2
(45) Date of Patent: Sep. 29, 2020

(54) METHOD FOR OPERATING FANS WITHIN AN APPLIANCE

(71) Applicant: General Electric Company, Schenectady, NY (US)

(72) Inventors: Cory Blaine Shoup, Louisville, KY (US); James Lee Armstrong, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 1350 days.

(21) Appl. No.: 14/945,886

(22) Filed: Nov. 19, 2015

(65) Prior Publication Data

US 2017/0150554 A1 May 25, 2017

(51) Int. Cl.
*H05B 6/64* (2006.01)

(52) U.S. Cl.
CPC ..... *H05B 6/645* (2013.01); *H05B 6/6423* (2013.01)

(58) Field of Classification Search
CPC ..... H05B 6/6423; H05B 6/645
USPC ..... 219/757, 623, 632, 756, 735, 731, 219/719–718, 710–712, 707, 687–686, 219/681, 682; 99/470, 517; 126/19.5; 373/74, 76, 113, 154, 158, 165
See application file for complete search history.

(56) References Cited

U.S. PATENT DOCUMENTS 4,886,046 A * 12/1989 Welch ..... F24C 15/006 219/757
5,308,956 A * 5/1994 Halters ..... F24C 15/325 126/21 R
6,974,937 B2 12/2005 Kim
2007/0194015 A1* 8/2007 Kim ..... H05B 6/6473 219/757
2011/0269085 A1* 11/2011 Wiker ..... A21B 1/40 432/4
2013/0309958 A1 11/2013 Bach et al.

FOREIGN PATENT DOCUMENTS

KR 10-1996-0016892 6/1999

* cited by examiner

*Primary Examiner* — Tu B Hoang
*Assistant Examiner* — Diallo I Duniver
(74) *Attorney, Agent, or Firm* — Dority & Manning, P.A.

(57) ABSTRACT

A method for operating fans within a microwave appliance is provided. The microwave appliance includes a sensor fan and an exhaust fan. The method includes operating the sensor fan of the microwave appliance when the exhaust fan of the microwave appliance is running. The sensor fan of the microwave appliances urges air over a sensor of the microwave appliance when the sensor fan is operating.

14 Claims, 6 Drawing Sheets

METHOD FOR OPERATING FANS WITHIN AN APPLIANCE

FIELD OF THE INVENTION

The subject matter of the present disclosure relates generally to methods for operating fans within appliances, such as over-the-range (OTR) microwave appliances or vent hood appliances.

BACKGROUND OF THE INVENTION

Over-the-range microwave appliances are generally mounted above a cooktop of an oven range appliance. Conventionally, cooktop appliances have been largely dependent upon a user monitoring the cooktop during use to determine, e.g., whether a pot of water is boiling or if a spill-over has occurred. There may be times, however, when a user may not be able to monitor the cooktop during use. Accordingly, a sensor may be mounted over the range, e.g., on an over-the-range microwave appliance, to monitor the cooktop positioned beneath the sensor.

However, a sensor mounted above the cooktop could become contaminated, e.g., by grease and moisture generated during use of the cooktop, which could impede the ability of the sensor to sense the cooktop. Thus, the sensor should be kept free from contamination by protection of the sensor lens.

In addition to providing for heating of food and beverage items, certain over-the-range microwave appliances include an air circulation system. When activated, the circulation system can draw fumes, smoke, grease, and/or steam away from the cooktop of the oven range appliance. Circulation systems generally include a fan for drawing a flow of air into the circulation system and a pathway for the flow of air. Additional fans or other elements may work with the circulation system to enhance the flow of air through the pathway.

Accordingly, a method for operating fans within an over-the-range microwave appliance in order to protect sensors of the microwave appliances would be useful.

BRIEF DESCRIPTION OF THE INVENTION

The present subject matter provides a method for operating fans within an appliance. The appliance includes a sensor fan and an exhaust fan. The method includes operating the sensor fan of the appliance when the exhaust fan of the appliance is running. The sensor fan of the appliances urges air over a sensor of the appliance when the sensor fan is operating. Additional aspects and advantages of the invention will be set forth in part in the following description, may be apparent from the description, or may be learned through practice of the invention.

In a first exemplary embodiment, a method for operating fans within an appliance is provided. The appliance includes a temperature sensor, a control panel, a control fan positioned adjacent the control panel, a cabinet defining a duct and an exhaust fan configured for drawing air through the duct. The temperature sensor includes a housing positioned at a bottom portion of the cabinet and having a chamber contiguous with the duct of the cabinet. The temperature sensor also includes a sensor fan configured for drawing air out of the duct of the cabinet via the chamber of the housing. The method includes operating the sensor fan at a first power when the exhaust fan is deactivated, activating the exhaust fan, and operating the sensor fan at a second power and activating the control fan after the exhaust fan is activated. The second power output is different than the first power output. The control fan and the sensor fan urge air out of the duct of the cabinet via the chamber of the housing when the sensor fan is operating at the second power and the control fan is activated.

In a second exemplary embodiment, a method for operating fans within an appliance is provided. The appliance includes a temperature sensor, a cabinet defining a duct and an exhaust fan configured for drawing air through the duct. The temperature sensor includes a housing positioned at a bottom portion of the cabinet and having a chamber contiguous with the duct of the cabinet. The temperature sensor also includes a sensor fan configured for drawing air out of the duct of the cabinet via the chamber of the housing. The method includes determining whether the exhaust fan is running and activating the sensor fan when the exhaust fan is running or when a temperature measurement from the temperature sensor exceeds a temperature limit and the exhaust fan is not running. The sensor fan urges air out of the duct of the cabinet via the chamber of the housing when the sensor fan is operating.

In a third exemplary embodiment, a method for operating fans within an appliance is provided. The appliance includes a temperature sensor, a control panel, a control fan positioned adjacent the control panel, a cabinet defining a duct and an exhaust fan configured for drawing air through the duct. The temperature sensor includes a housing positioned at a bottom portion of the cabinet and having a chamber contiguous with the duct of the cabinet. The temperature sensor also includes a sensor fan configured for drawing air out of the duct of the cabinet via the chamber of the housing. The method includes determining whether the sensor is positioned proximate a heating element of a range in response to receiving a heating element activation signal from the range and operating the sensor fan at a first power when the sensor is positioned proximate the heating element of the range or operating the sensor fan at a second power when the sensor is positioned proximate the heating element of the range and the exhaust fan is running. The second power output is different than the first power output. The sensor fan urges air out of the duct of the cabinet via the chamber of the housing when the sensor fan is operating.

In a fourth exemplary embodiment, a method for operating fans within an appliance is provided. The appliance includes a temperature sensor, a control panel, a control fan positioned adjacent the control panel, a cabinet defining a duct and an exhaust fan configured for drawing air through the duct. The temperature sensor includes a housing positioned at a bottom portion of the cabinet and having a chamber contiguous with the duct of the cabinet. The temperature sensor also includes a sensor fan configured for drawing air out of the duct of the cabinet via the chamber of the housing. The method includes operating the sensor fan at a first power in response to receiving a heating element activation signal from a range and operating the sensor fan at a second power when the exhaust fan is running. The second power output is different than the first power output. The sensor fan urges air out of the duct of the cabinet via the chamber of the housing when the sensor fan is operating.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Use of the same reference numerals in different figures denotes the same or similar features.

DETAILED DESCRIPTION OF THE INVENTION

Figure 1:
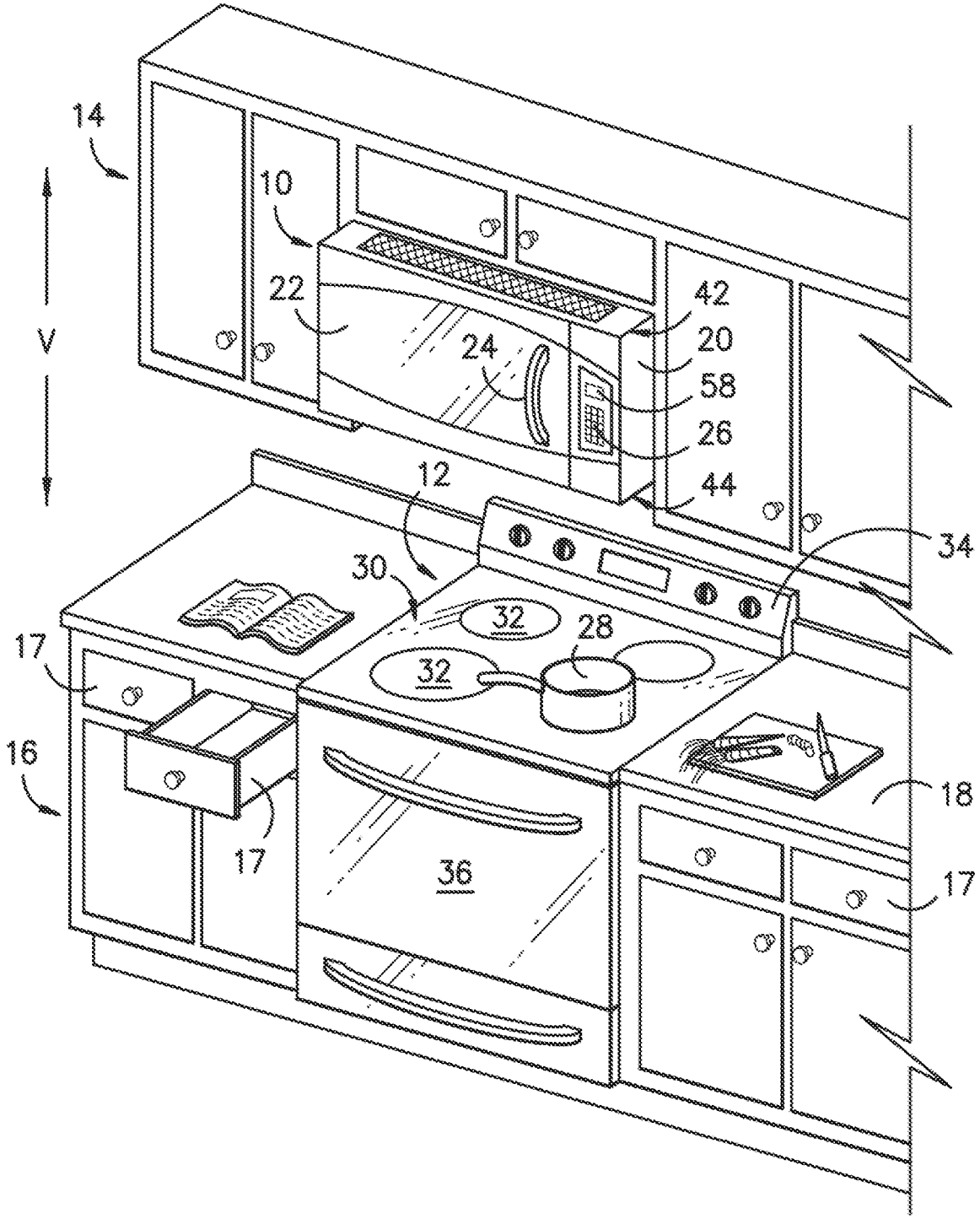
FIG. 1 provides a perspective view of a microwave appliance according to an exemplary embodiment of the present subject matter mounted to a kitchen cabinet above an oven range appliance.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a microwave appliance 10 according to an exemplary embodiment of the present subject matter mounted to an upper set of kitchen cabinets 14 above an oven range appliance 12, e.g., along a vertical direction V. Microwave appliance 10 shown in FIG. 1 is commonly referred to as an over-the-range microwave. Upper set of kitchen cabinets 14 is positioned above a base set of kitchen cabinets 16, e.g., along the vertical direction V. Base set of kitchen cabinets 16 includes countertops 18 and drawers 17. Oven range appliance 12 is received within base set of kitchen cabinets 16 below microwave appliance 10. In particular, a cooking surface 30 of oven range appliance 12 is positioned, e.g., directly, below microwave appliance 10 along the vertical direction V. Microwave appliance 10 can include features such as an air handler or cooling fan 52 (FIG. 2) that can draw cooking vapors and/or smoke away from cooking surface 30 and out of the kitchen containing microwave and oven range appliances 10, 12.

Microwave appliance 10 is configured for receipt of food items for cooking. In particular, microwave appliance 10 includes a cabinet or casing 20 and a door 22 that permits selective access to an interior of microwave appliance 10 and casing 20. Door 22 includes a handle 24 that a user can pull to open door 22 to insert food items into microwave appliance 10. Microwave appliance 10 also includes controls 26 that permit a user to make selections for cooking of food items, e.g., a duration of a cooking cycle of microwave appliance 10 and/or a power setting for the cooking cycle of microwave appliance 10.

Oven range appliance 12 includes cooking surface 30. Cooking surface 30 includes heated portions 32 that may be heated by heating elements (not shown), e.g., electrical resistive heating elements, gas burners, induction heating elements, and/or any other suitable heating element or combination of heating elements. Oven range appliance 12 also includes a door 36 that permits access to a heated compartment (not shown) of oven range appliance 12, e.g., for cooking or baking of food items therein. A control panel 34 of oven range appliance 12 can permit a user to make selections for cooking of food items, e.g., a duration of a cooking cycle of oven range appliance 12 and/or a power setting for the cooking cycle of oven range appliance 12.

Figure 2:
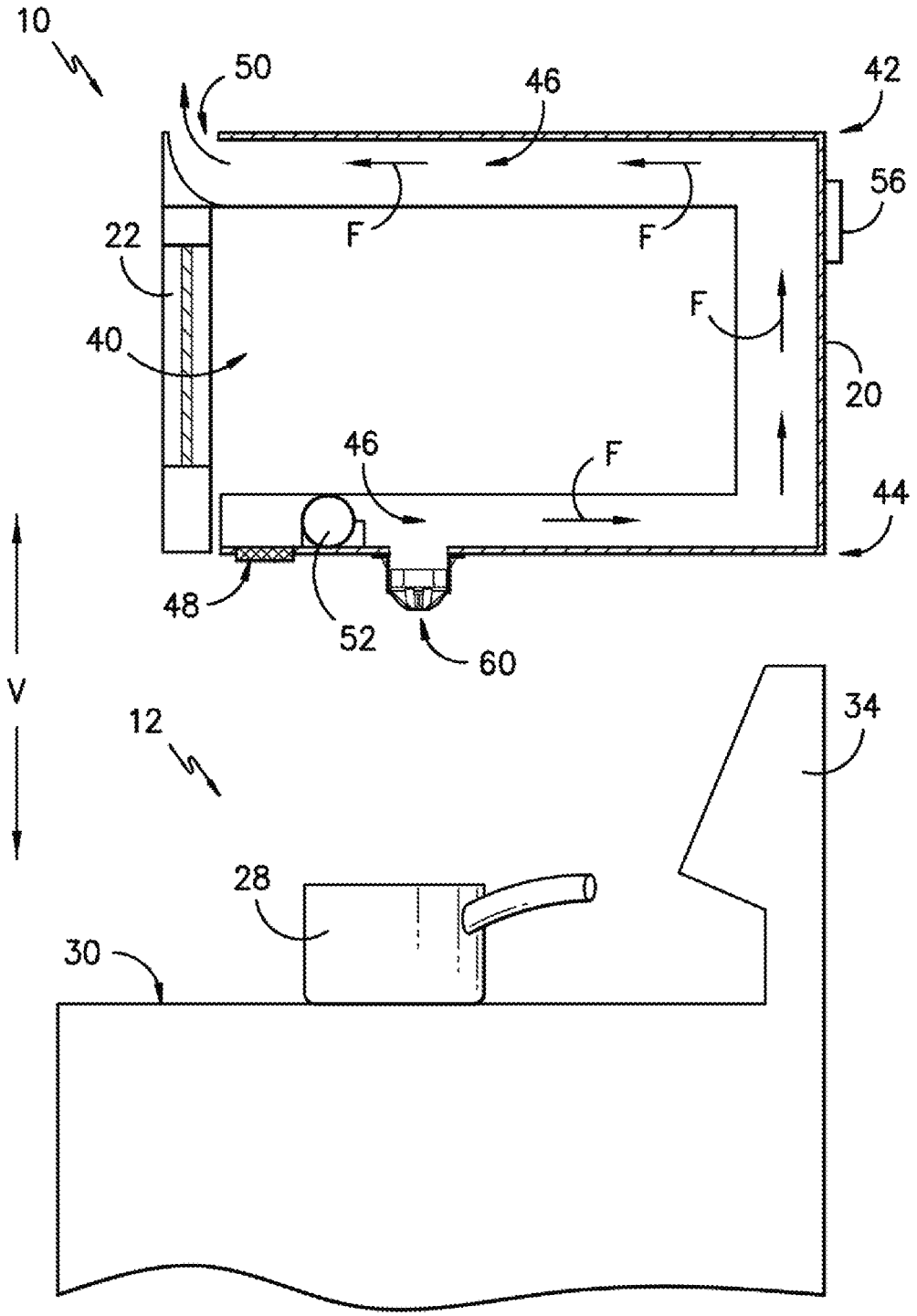
FIG. 2 provides a side, section view of the exemplary microwave appliance and oven range appliance of FIG. 1.

FIG. 2 provides a side, section view of microwave appliance 10 and oven range appliance 12. As illustrated, casing 20 extends between a top portion 42 and a bottom portion 44, e.g., along the vertical direction V. Thus, top and bottom portions 42 and 44 of casing 20 are spaced apart from each other, e.g., along the vertical direction V. Casing 20 defines a cooking chamber 40 configured for receipt of food items for cooking. Door 22 of microwave appliance 10 permits selective access to cooking chamber 40 of casing 20. In particular, door 22 of microwave appliance 10 is selectively adjustable between an open position (not shown) and a closed position (FIGS. 1 and 2). In the closed position, door 22 of microwave appliance 10 hinders access to cooking chamber 40 of casing 20. Conversely, door 22 of microwave appliance 10 permits access to cooking chamber 40 of casing 20 in the open position. A user can pull on handle 24 of door 22 of microwave appliance 10 in order to shift door 22 from the closed position shown in FIG. 2 to the open position.

Casing 20 also defines an air conduit or pathway 46. Pathway 46 has an inlet 48 and an outlet 50. Pathway 46 extends between inlet 48 and outlet 50. Inlet 48 of pathway 46 is positioned at or adjacent bottom portion 44 of casing 20, e.g., such that inlet 48 of pathway 46 faces cooking surface 30 of oven range appliance 12. Conversely, outlet 50 of pathway 46 is positioned at or adjacent top portion 42 of casing 20, e.g., such that outlet 50 of pathway 46 faces away from cooking surface 30 of oven range appliance 12. In certain exemplary embodiments, outlet 50 may face in the opposite direction, although preferably not toward cooking surface 30. Thus, inlet 48 and outlet 50 of pathway 46 are spaced apart from each other, e.g., along the vertical direction V.

Microwave appliance 10 also includes a vent fan 52, such as an axial fan or a radial fan. Vent fan 52 is positioned within or adjacent pathway 46. Vent fan 52 draws or urges a flow of air (shown with arrows F) through pathway 46 when vent fan 52 is in an activated state. Conversely, cooling fan 52 does not draw or urge flow of air F through pathway 46 when cooling fan 52 is in a deactivated state. When cooling fan 52 is in the activated state, flow of air F enters pathway 46 at or through inlet 48 of pathway 46. Flow of air F is directed through pathway 46 to outlet 50, and flow of air F can exit pathway 46 at outlet 50 of pathway 46. In such a manner, vent fan 52 may draw cooking fumes from oven range appliance 10 through pathway 46, e.g., such that microwave appliance 10 acts as a hood for oven range appliance 12, as will be understood by those skilled in the art.

As may be seen in FIG. 2, microwave appliance 10 may further include a controller 56. Operation of microwave appliance 10 may be regulated by controller 56. Controller 56 is operatively coupled or in communication with various components of microwave appliance 10, including controls 26. In response to user manipulation of controls 26, controller 56 operates the various components of microwave appliance 10 to execute selected cycles and features. Controller 56 may also be in operative communication with cooling fan 52. Thus, controller 56 can selectively adjust cooling fan 52 between the activated and deactivated states to regulate the flow of air F through pathway 46.

Controller 56 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 56 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Controls 26 and other components of microwave appliance 10 may be in communication with controller 56 via one or more signal lines or shared communication busses.

Microwave appliance 10 and oven range appliance 12 may be in signal communication with each other, e.g., via a network. Thus, microwave appliance 10 and oven range appliance 12 may each include suitable components for interfacing with one more networks. For example, network interfaces of microwave appliance 10 and oven range appliance 12 may include transmitters, receivers, ports, controllers, antennas, or other suitable components for interfacing with an associated network, e.g., wired or wireless. The network between microwave appliance 10 and oven range appliance 12 may be any type of communications network, such as a local area network (e.g. intranet), wide area network (e.g. Internet), or some combination thereof. In general, communication between microwave appliance 10 and oven range appliance 12 may be carried via associated network interfaces using any type of connection, using a variety of communication protocols (e.g. TCP/IP, HTTP), encodings or formats (e.g. HTML, XML), and/or protection schemes (e.g. VPN, secure HTTP, SSL).

Additionally, microwave appliance 10 may support a sensor system 60 such that cooking surface 30 is positioned beneath sensor system 60. Sensor system 60 includes a sensor 62 for monitoring cooking surface 30 and any cooking utensils containing food items for cooking, such as, e.g., cooking utensil 28, on cooking surface 30. More particularly, sensor 62 is configured, e.g., to detect whether a cooking utensil is present on cooking surface 30 and, if so, to provide a signal indicative of the same to controller 56. Sensor 62 may also be equipped with other features such as, e.g., the ability to determine (and provide a signal indicative of) the temperature of the cooktop, a utensil placed on the cooktop, and/or food present on the cooktop. Sensor 62 may be an optical sensor or any other sensor suitable for monitoring cooking surface 30. Further, sensor 62 may be in operative communication with controller 56, which may output an indicator signal to, e.g., a controls display 58 of microwave appliance 10 or another suitable source to alert a user to the status of cooking surface 30 or food items within cooking utensils 28 on cooking surface 30. As shown in FIG. 2, sensor system 60 may be in fluid communication with pathway 46. More particularly, air flowing through pathway 46 may also cause air to flow through sensor system 60, as will be further described.

Figure 3:
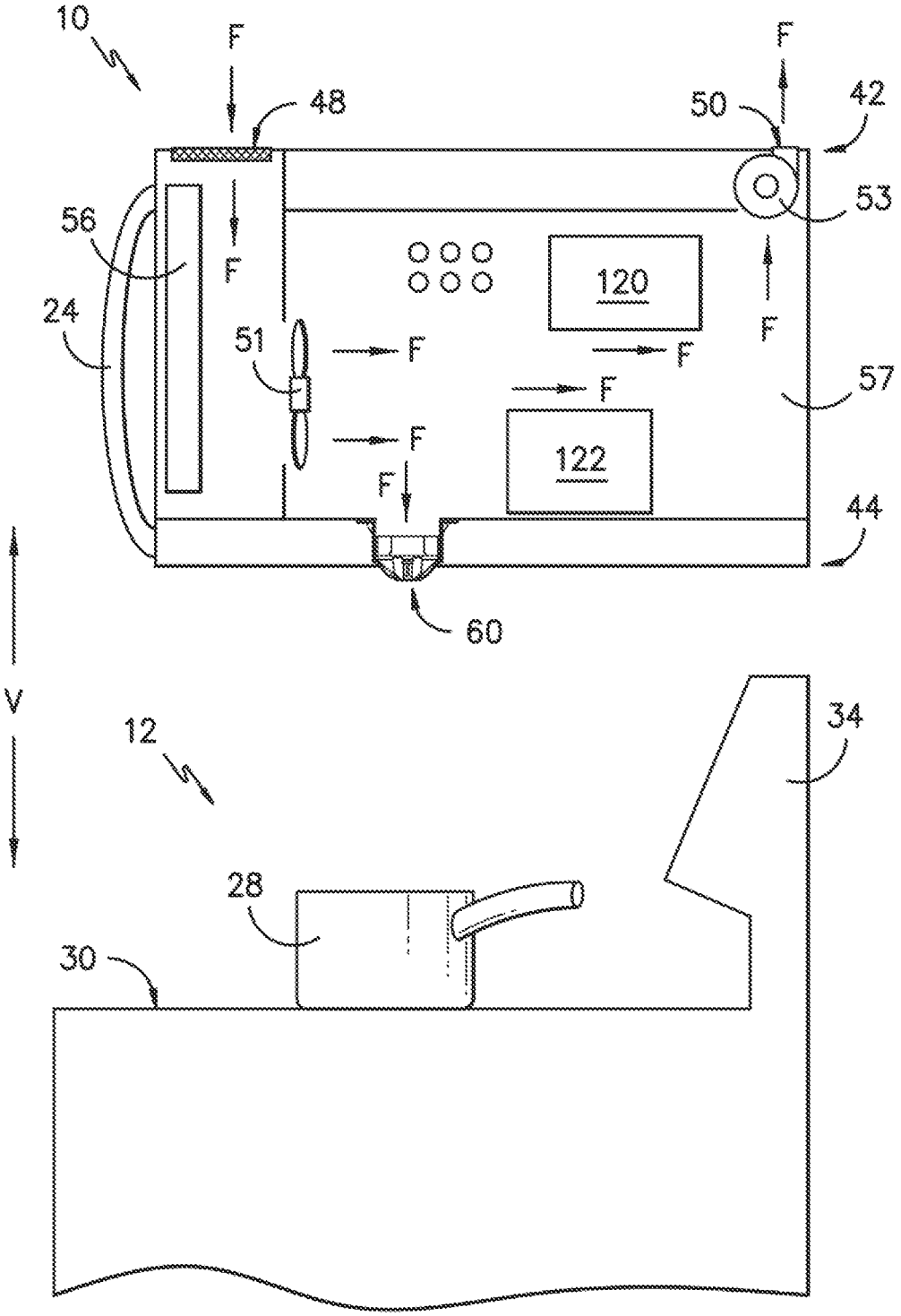
FIG. 3 provides another side, section view of the exemplary microwave appliance and oven range appliance of FIG. 1.

As an example, in the exemplary embodiment illustrated in FIG. 3, microwave appliance 10 includes a control fan 51 that creates a flow of air F through a controls duct or compartment 57, in which controller 56 is positioned. More particularly, control fan 51 draws air through inlet 48 and past controller 56 and a magnetron 120 and power supply 122 within compartment 57. Additionally, an exhaust fan 53 draws or urges air flow F to exit compartment 57 through outlet 50. Sensor system 60 is in fluid communication with compartment 57 such that air flowing through compartment 57 also causes air to flow through sensor system 60 as will be described. Other configurations of microwave appliance 10 and sensor system 60 may also be used, or sensor system 60 could be supported by any other suitable appliance or surface. In certain exemplary embodiments, cooling fan 52 and exhaust fan 53 may be a common or single fan.

It should be understood that sensor system 60 may be used in or with any other suitable appliance in alternative embodiments. Thus, while described in the context of microwave appliance 10, it should be understood that sensor system 60 may be used in other appliances in alternative exemplary embodiments. For example, sensor system 60 may be mounted on or within a vent hood appliance over oven range appliance 12. The vent hood appliance may include the same or similar fans as described above for microwave appliance 10.

Figure 4:
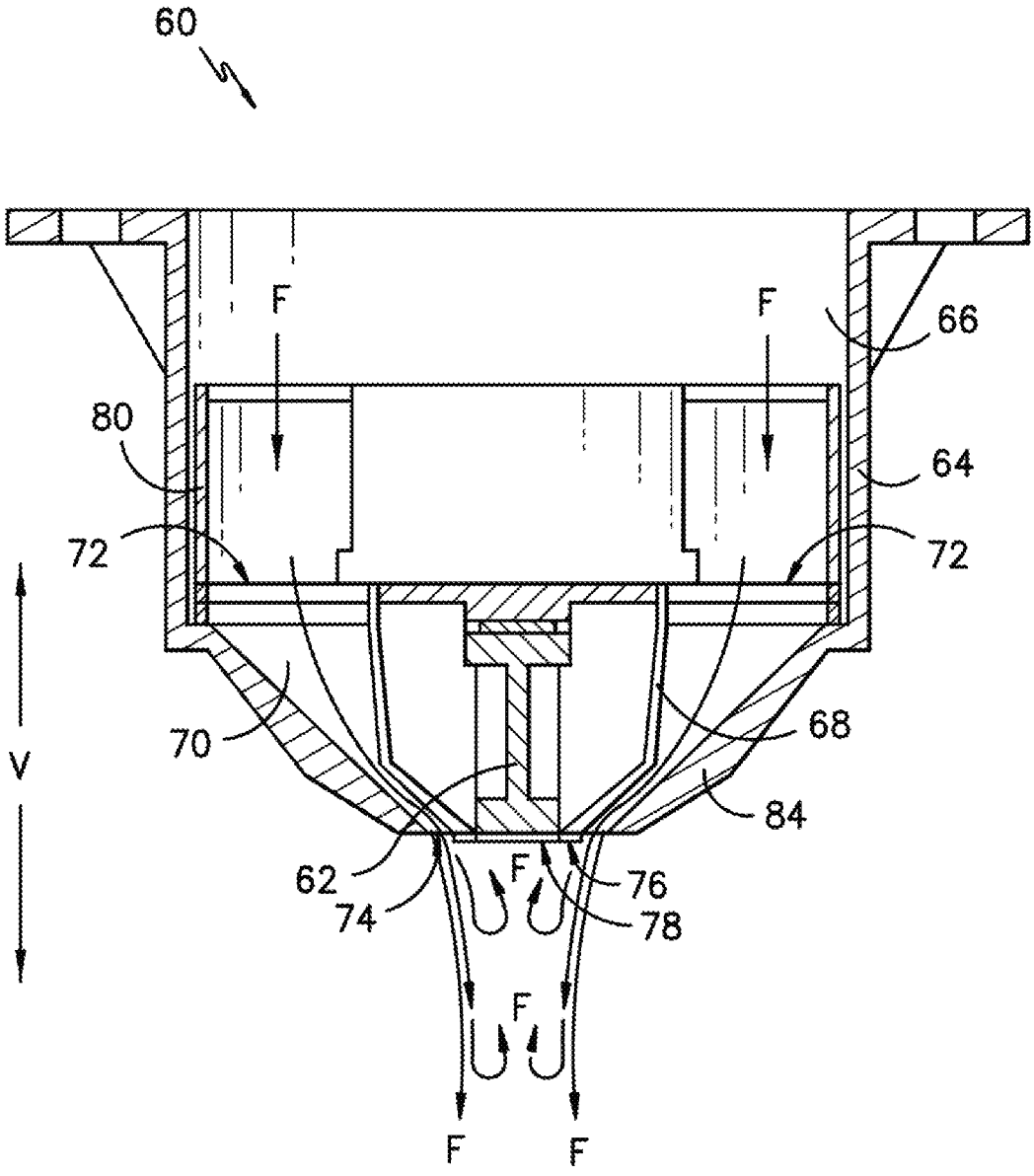
FIG. 4 provides a section view of a sensor of the exemplary microwave appliance of FIG. 1.

FIG. 4 provides a section view of sensor system 60. As an example, sensor system 60 may be constructed in the same or a similar manner to the sensor system described in U.S. Patent Publication No. 2015/0260193 of James Lee Armstrong et al. entitled "Sensing System for a Cooktop Appliance with Airflow Protected Sensor" and/or U.S. Patent Publication No. 2015/0257591 of James Lee Armstrong et al. also entitled "Sensing System for a Cooktop Appliance with Airflow Protected Sensor," both of which are hereby incorporated by reference in their entirety for all purposes.

As shown in FIG. 4, sensor 62 of sensor system 60 is contained within an inner housing 68 that is positioned within an outer housing 64. Outer housing 64 defines a chamber 66 that is in fluid communication with compartment 57 (and/or pathway 46). Inner housing 68 is positioned within chamber 66 such that inner housing 68 and outer housing 64 define a channel 70 for a flow of air F. Moreover, inner housing 68 defines a sensor aperture 76, and a sensing end 78 of sensor 62 is positioned at sensor aperture 76. Sensor aperture 76 may be open or may have a protective covering such as, e.g., a glass lens.

Channel 70 has a channel inlet 72 positioned downstream of control fan 51 and in fluid communication with chamber 66 to receive a flow of air F from compartment 57. Further, channel 70 has a channel outlet 74 from which the flow of air F flows past sensing end 78 of sensor 62. The flow of air F acts to protect sensing end 78 by blowing away, e.g., moisture, grease, or other contaminants generated during use of the cooking surface 30 that might otherwise block or impede the proper operation of sensor 62.

A sensor fan 80 is positioned within chamber 66 of outer housing 68 adjacent channel inlet 72. Sensor fan 80 may be used in addition to control fan 51 and/or exhaust fan 53 to create air flow F. Sensor fan 80 may also be used instead of control fan 51 and/or exhaust fan 53 to create air flow F. Thus, sensor fan 80 is in operative communication with controller 56 and is configured to urge the flow of air F through channel 70 and past sensing end 78 of sensor 62 to keep sensing end 78 free from contamination. Control fan 51 and/or exhaust fan 53 may assist sensor fan 80 with urging the flow of air F through channel 70 and past sensing end 78 of sensor 62.

Figure 5:
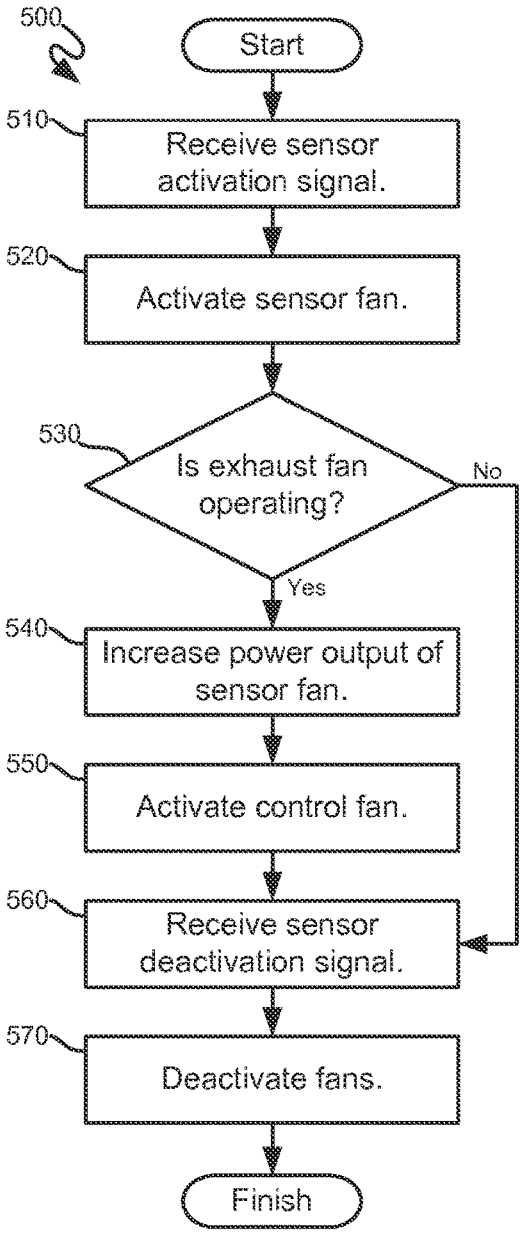
FIG. 5 illustrates a method of operating fans within an appliance in accordance with a first exemplary embodiment of the present subject matter.

FIG. 5 illustrates a method 500 of operating fans within an appliance in accordance with a first exemplary embodiment of the present subject matter. Method 500 may be used in or with any suitable appliance, such as a microwave appliance or a vent hood appliance. For example, method 500 may be used in or with microwave appliance 10, e.g., to regulate or control at least one of control fan 51, cooling fan 52, exhaust fan 53 and sensor fan 80. Controller 56 of microwave appliance 10 may be configured or programmed to implement method 500. Thus, method 500 is discussed in greater detail below in the context of microwave appliance 10. Method 500 may assist with limiting or preventing ambient air about microwave appliance 10 from flowing into microwave appliance 10 via sensor system 60, e.g., through chamber 66 of outer housing 68. In such a manner, accumulation of particles and other debris on sensor 62 from ambient air about microwave appliance 10 may be reduced or limited and performance of sensor system 60 may be improved.

At step 510, controller 56 receives a sensor activation signal from oven range appliance 12 or from controls 26 of microwave appliance 10. As an example, a user of oven range appliance 12 may utilize control panel 34 to activate one of heated portions 32 of oven range appliance 12. In response to the user input at control panel 34 and/or the activation of one of heated portions 32, oven range appliance 12 may transmit the sensor activation signal to microwave appliance 10. Microwave appliance 10 and oven range appliance 12 may communicate with each other via a network in order to transmit the sensor activation signal from oven range appliance 12 to microwave appliance 10 at step 510.

At step 520, controller 56 operates sensor fan 80 at a first power. When sensor fan 80 is operating at the first power, sensor fan 80 may draw air through chamber 66 over sensor 62 in order to limit or prevent particle accumulation on sensor 62. Thus, the flow of air F through chamber 66 out of sensor 62 may assist with shielding sensor 62 and keeping sensor 62 clean. Exhaust fan 53 may be deactivated at step 520.

At step 530, controller 56 determines whether exhaust fan 53 is operating, turned on or activated. Thus, e.g., a user of microwave appliance 10 may operate microwave appliance 10 such that exhaust fan 53 activates between steps 520 and 530. If exhaust fan 53 is not operating at step 530, method 500 continues to step 560. Conversely, controller 56 increases a power supplied to sensor fan 80 at step 540 if exhaust fan 53 is operating at step 530. In particular, controller 56 may increases the power supplied to sensor fan 80 from the first power to a second power at step 540, with the second power being different (e.g., greater) than the first power. It should be understood that the first and second powers may be equal in certain exemplary embodiments, e.g., when the first and second powers are both high powers.

Exhaust fan 53 may be larger than sensor fan 80, and exhaust fan 53 may urge or draw air to exhaust fan 53 fan via any air pathway, such as chamber 66 of sensor 60, during operation of exhaust fan 53. Thus, with sensor fan 80 operating at a first power, exhaust fan 53 may overpower sensor fan 80 and draw ambient air about microwave appliance 10 into sensor system 60 via chamber 66 of outer housing 68. By increasing the power supplied to sensor fan 80 from the first power to the second power when exhaust fan 53 is operating at step 530, sensor fan 80 may continue to draw air through chamber 66 over sensor 62 in order to limit or prevent particle accumulation on sensor 62, and the flow of air F through chamber 66 out of sensor 62 may continue to assist with shielding sensor 62 and keeping sensor 62 clean when sensor fan 80 is operating at the second power by counteracting the draw of exhaust fan 53.

At step 550, controller 56 may also activate, turn on or operate control fan 51. When activated control fan 51 may assist sensor fan 80 with drawing air through chamber 66 over sensor 62 in order to limit or prevent particle accumulation on sensor 62. In particular, as shown in FIG. 3, control fan 51 may be disposed upstream of exhaust fan 53 and sensor fan 80 relative to the flow of air F. Thus, by activating control fan 51 at step 550, control fan 51 may assist sensor fan 80 with maintaining the flow of air F through chamber 66 out of sensor 62 when exhaust fan 53 is operating.

At step 560, controller 56 receives a sensor deactivation signal from oven range appliance 12. As an example, a user of oven range appliance 12 may utilize control panel 34 to deactivate heated portions 32 of oven range appliance 12. In response to the user input at control panel 34 and/or the deactivation of one of heated portions 32, oven range appliance 12 may transmit the sensor deactivation signal to microwave appliance 10. At step 570, controller 56 may deactivate control fan 51, cooling fan 52, exhaust fan 53 and/or sensor fan 80 after the sensor deactivation signal is received at step 570. Thus, once cooking operations on oven range appliance 12 are complete, and smoke/fumes from oven range appliance 12 are diffused, controller 56 may deactivate control fan 51, cooling fan 52, exhaust fan 53 and/or sensor fan 80. In such a manner, method 500 may selectively operate control fan 51, exhaust fan 53 and/or sensor fan 80 in order to generate the flow of air F over sensor 62 as needed, e.g., during operation of oven range appliance 12.

Figure 6:
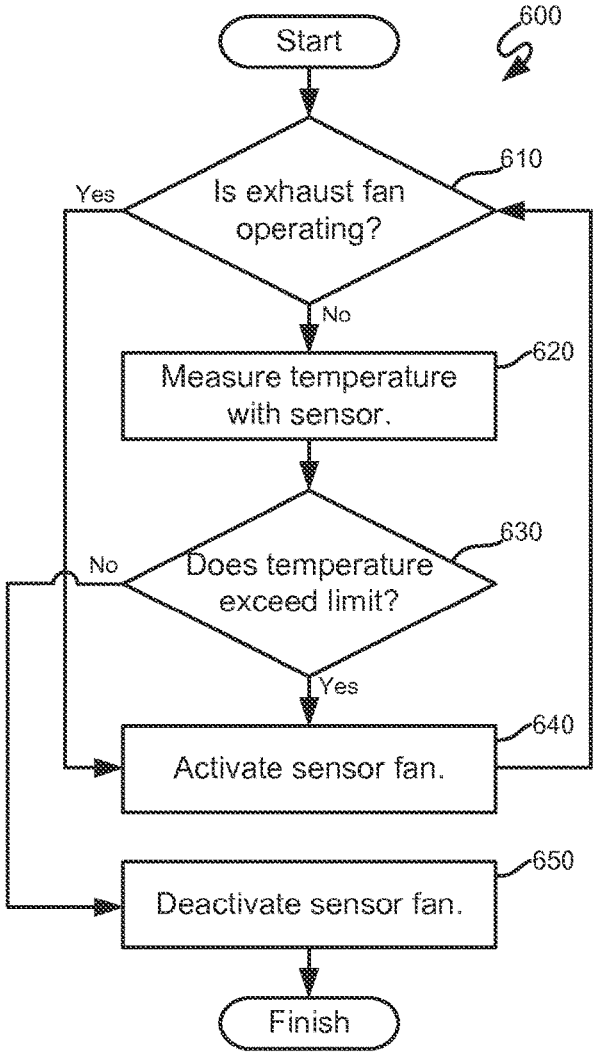
FIG. 6 illustrates a method of operating fans within an appliance in accordance with a second exemplary embodiment of the present subject matter.

FIG. 6 illustrates a method 600 of operating fans within a microwave appliance in accordance with a second exemplary embodiment of the present subject matter. Method 600 may be used in or with any suitable appliance, such as a microwave appliance or a vent hood appliance. For example, method 600 may be used in or with microwave appliance 10, e.g., to regulate or control at least one of control fan 51, cooling fan 52, exhaust fan 53 and sensor fan 80. Controller 56 of microwave appliance 10 may be configured or programmed to implement method 600. Thus, method 600 is discussed in greater detail below in the context of microwave appliance 10. Method 600 may assist with limiting or preventing ambient air about microwave appliance 10 from flowing into microwave appliance 10 via sensor system 60, e.g., through chamber 66 of outer housing 68. In such a manner, accumulation of particles and other debris on sensor 62 from ambient air about microwave appliance 10 may be reduced or limited and performance of sensor system 60 may be improved.

At step 610, controller 56 determines whether exhaust fan 53 is operating, turned on or activated. Thus, e.g., a user of microwave appliance 10 may activate microwave appliance 10 such that exhaust fan 53 turns on prior to step 610. If exhaust fan 53 is operating at step 610, method 600 continues to step 640. Conversely, controller 56 utilizes sensor 62 to measure a temperature, e.g., of a cooking utensil on one of heated portions 32 or food within the cooking utensil, at step 620 if exhaust fan 53 is not operating at step 610. As an example, controller 56 may receive a signal from sensor 62 that corresponds to a temperature measurement at step 620.

At step 630, controller 56 determines whether the temperature measurement from sensor 62 exceeds a temperature limit. If the temperature measurement from sensor 62 exceeds the temperature limit at step 630, method 600 continues to step 640. At step 640, controller 56 operates sensor fan 80. When oven range appliance 12 is operating and cooking food within a cooking utensil on one of heated portions 32, the food may emit smoke, fumes, vapors, etc., and such fluids may rise towards microwave appliance 10. In particular, such fluids may flow towards sensor 62 during operation of oven range appliance 12. However, when sensor fan 80 is operating at step 640, sensor fan 80 may draw air through chamber 66 over sensor 62 in order to limit or prevent particle accumulation on sensor 62. Thus, the flow of air F through chamber 66 out of sensor 62 may assist with shielding sensor 62 and keeping sensor 62 clean. Thus, by monitoring temperature measurements from sensor 62 at steps 620, 630, controller 56 may activate sensor fan 80 at step 640 to provide the flow of air F over sensor 62 and keep sensor 62 clean during operation of oven range appliance 12. Similar, controller 56 may activate sensor fan 80 at step 640 to provide the flow of air F over sensor 62 and keep sensor 62 clean during operation of oven range appliance if exhaust fan 53 is operating at step 610, e.g., in order to overcome the draw of exhaust fan 53, as discussed above.

If the temperature measurement from sensor 62 does not exceed the temperature limit at step 630, method 600 continues to step 650. At step 650, controller 56 deactivates sensor fan 80. Thus, when temperature measurements from sensor 62 drop below the temperature limit, controller 56 may deactivate sensor fan 80 at step 650 in order to terminate the flow of air F over sensor 62, e.g., because the flow of air F is no longer needed. In such a manner, method 600 may selectively operate sensor fan 80 in order to generate the flow of air F over sensor 62 as needed, e.g., during operation of oven range appliance 12.

Figure 7:
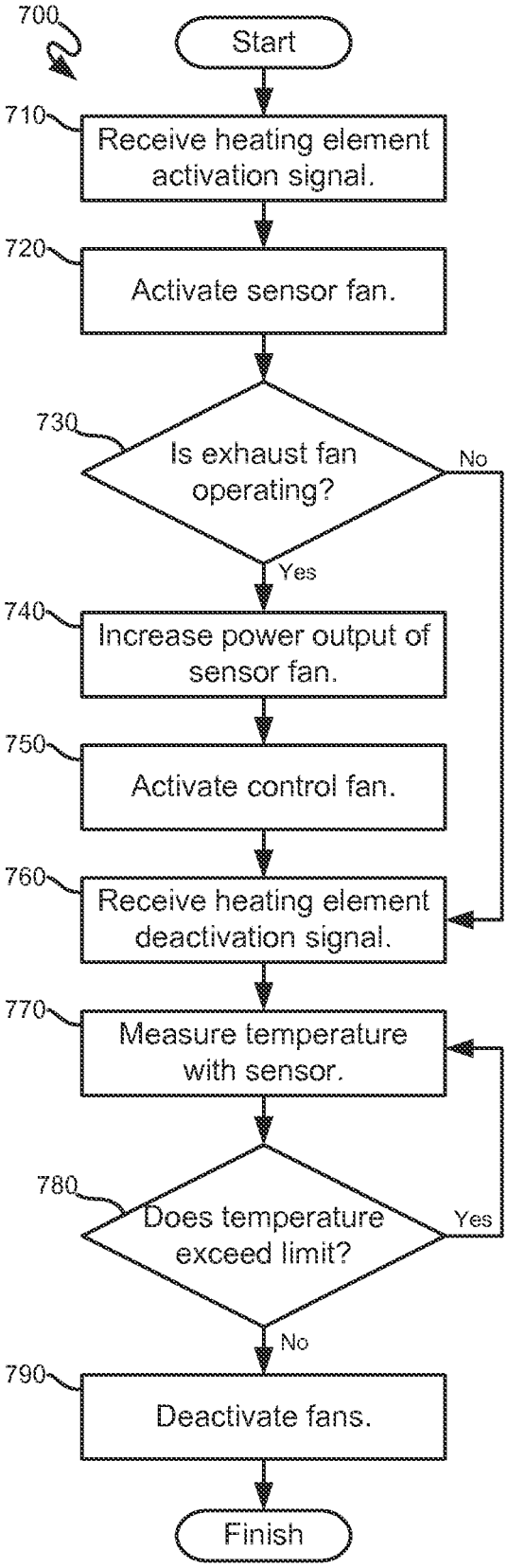
FIG. 7 illustrates a method of operating fans within an appliance in accordance with a third exemplary embodiment of the present subject matter.

FIG. 7 illustrates a method 700 of operating fans within a microwave appliance in accordance with a third exemplary embodiment of the present subject matter. Method 700 may be used in or with any suitable appliance, such as a microwave appliance or a vent hood appliance. For example, method 700 may be used in or with microwave appliance 10, e.g., to regulate or control at least one of control fan 51, cooling fan 52, exhaust fan 53 and sensor fan 80. Controller 56 of microwave appliance 10 may be configured or programmed to implement method 700. Thus, method 700 is discussed in greater detail below in the context of microwave appliance 10. Method 700 may assist with limiting or preventing ambient air about microwave appliance 10 from flowing into microwave appliance 10 via sensor system 60, e.g., through chamber 66 of outer housing 68. In such a manner, accumulation of particles and other debris on sensor 62 from ambient air about microwave appliance 10 may be reduced or limited and performance of sensor system 60 may be improved.

At step 710, controller 56 receives a sensor activation signal from oven range appliance 12. As an example, a user of oven range appliance 12 may utilize control panel 34 to activate one of heated portions 32 of oven range appliance 12. In response to the user input at control panel 34 and/or the activation of one of heated portions 32, oven range appliance 12 may transmit the sensor activation signal to microwave appliance 10. Microwave appliance 10 and oven range appliance 12 may communicate with each other via a network in order to transmit the sensor activation signal from oven range appliance 12 to microwave appliance 10 at step 710.

At step 720, controller 56 operates sensor fan 80 at a first power. When sensor fan 80 is operating at the first power, sensor fan 80 may draw air through chamber 66 over sensor 62 in order to limit or prevent particle accumulation on sensor 62. Thus, the flow of air F through chamber 66 out of sensor 62 may assist with shielding sensor 62 and keeping sensor 62 clean. Exhaust fan 53 may be deactivated at step 720.

At step 730, controller 56 determines whether exhaust fan 53 is operating, turned on or activated. Thus, e.g., a user of microwave appliance 10 may operate microwave appliance 10 such that exhaust fan 53 activates between steps 720 and 730. If exhaust fan 53 is not operating at step 730, method 700 continues to step 760. Conversely, controller 56 increases a power supplied to sensor fan 80 at step 740 if exhaust fan 53 is operating at step 730. In particular, controller 56 may increases the power supplied to sensor fan 80 from the first power to a second power at step 740, with the second power being different (e.g., greater) than the first power. It should be understood that the first and second powers may be equal in certain exemplary embodiments, e.g., when the first and second powers are both high powers.

Exhaust fan 53 may be larger than sensor fan 80, and exhaust fan 53 may urge or draw air to exhaust fan 53 fan via any air pathway, such as chamber 66 of sensor 60, during operation of exhaust fan 53. Thus, with sensor fan 80 operating at a first power, exhaust fan 53 may overpower sensor fan 80 and draw ambient air about microwave appliance 10 into sensor system 60 via chamber 66 of outer housing 68. By increasing the power supplied to sensor fan 80 from the first power to the second power when exhaust fan 53 is operating at step 730, sensor fan 80 may continue to draw air through chamber 66 over sensor 62 in order to limit or prevent particle accumulation on sensor 62, and the flow of air F through chamber 66 out of sensor 62 may continue to assist with shielding sensor 62 and keeping sensor 62 clean when sensor fan 80 is operating at the second power by counteracting the draw of exhaust fan 53.

At step 750, controller 56 may also activate, turn on or operate control fan 51. When activated control fan 51 may assist sensor fan 80 with drawing air through chamber 66 over sensor 62 in order to limit or prevent particle accumulation on sensor 62. In particular, as shown in FIG. 3, control fan 51 may be disposed upstream of exhaust fan 53 and sensor fan 80 relative to the flow of air F. Thus, by activating control fan 51 at step 750, control fan 51 may assist sensor fan 80 with maintaining the flow of air F through chamber 66 out of sensor 62 when exhaust fan 53 is operating.

At step 760, controller 56 receives a sensor deactivation signal from oven range appliance 12. As an example, a user of oven range appliance 12 may utilize control panel 34 to deactivate heated portions 32 of oven range appliance 12. In response to the user input at control panel 34 and/or the deactivation of one of heated portions 32, oven range appliance 12 may transmit the sensor deactivation signal to microwave appliance 10.

At step 770, controller 56 utilizes sensor 62 to measure a temperature, e.g., of a cooking utensil on one of heated portions 32 or food within the cooking utensil. As an example, controller 56 may receive a signal from sensor 62 that corresponds to a temperature measurement at step 770. Thus, after receiving the sensor deactivation signal from oven range appliance 12, controller 56 may start monitoring temperature measurements from sensor 62.

At step 780, controller 56 determines whether the temperature measurement from sensor 62 exceeds a temperature limit. If the temperature measurement from sensor 62 does not exceed the temperature limit at step 770, controller 56 continues to monitor temperature measurements from sensor 62. While monitoring temperature measurements from sensor 62, sensor fan 80 and/or control fan 51 may continue to operate. Even when oven range appliance 12 is deactivated, the food on oven range appliance 12 may emit smoke, fumes, vapors, etc., and such fluids may rise towards microwave appliance 10, e.g., due to the heat remaining in heated portions 32 or cooking utensils. In particular, such fluids may flow towards sensor 62 during operation of oven range appliance 12. However, when sensor fan 80 and/or control fan 51 are operating, sensor fan 80 and/or control fan 51 may draw air through chamber 66 over sensor 62 in order to limit or prevent particle accumulation on sensor 62. Thus, the flow of air F through chamber 66 out of sensor 62 may assist with shielding sensor 62 and keeping sensor 62 clean. By monitoring temperature measurements from sensor 62 at steps 770, 780, controller 56 may keep sensor fan 80 and/or control fan 51 activated until oven range appliance 12 cools.

Method 700 continues to step 790 if the temperature measurement from sensor 62 does not exceed the temperature limit at step 770. At step 790, controller 56 deactivates sensor fan 80. Thus, when temperature measurements from sensor 62 drop below the temperature limit, controller 56 may deactivate sensor fan 80 at step 650 in order to terminate the flow of air F over sensor 62, e.g., because the flow of air F is no longer needed. In such a manner, once cooking operations on oven range appliance 12 are complete, and smoke/fumes from oven range appliance 12 are diffused, controller 56 may deactivate control fan 51, cooling fan 52, exhaust fan 53 and/or sensor fan 80. In such a manner, method 700 may selectively operate control fan 51, exhaust fan 53 and/or sensor fan 80 in order to generate the flow of air F over sensor 62 as needed, e.g., during operation of oven range appliance 12.

Figure 8:
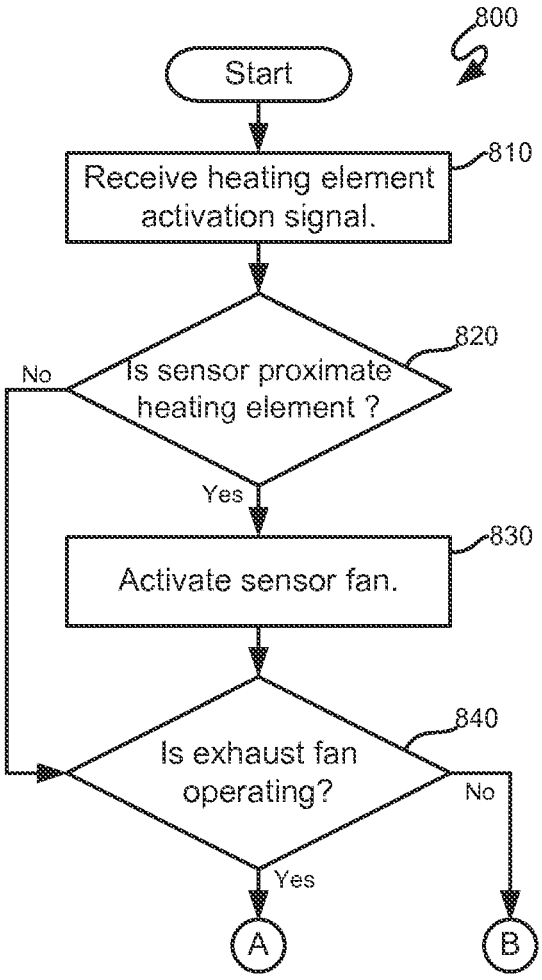
FIG. 8 illustrates a method of operating fans within an appliance in accordance with a fourth exemplary embodiment of the present subject matter.

FIG. 8 illustrates a method 800 of operating fans within a microwave appliance in accordance with a fourth exemplary embodiment of the present subject matter. Method 800 may be used in or with any suitable appliance, such as a microwave appliance or a vent hood appliance. For example, method 800 may be used in or with microwave appliance 10, e.g., to regulate or control at least one of control fan 51, cooling fan 52, exhaust fan 53 and sensor fan 80. In particular, method 800 may supplement method 700, as discussed in greater detail below. Controller 56 of microwave appliance 10 may be configured or programmed to implement method 800. Thus, method 800 is discussed in greater detail below in the context of microwave appliance 10. Method 800 may assist method 700 with limiting or preventing ambient air about microwave appliance 10 from flowing into microwave appliance 10 via sensor system 60, e.g., through chamber 66 of outer housing 68. In such a manner, accumulation of particles and other debris on sensor 62 from ambient air about microwave appliance 10 may be reduced or limited and performance of sensor system 60 may be improved.

Steps 810, 820, 830 and 840 may be performed during method 700, as discussed in greater detail below. In particular, step 810 may correspond to step 710 from method 700. At step 820, controller 56 determines whether sensor 62 is proximate the heated portion 32 of oven range appliance 12 activated at step 810. For example, controller 56 may determine whether sensor 62 is positioned directly above the heated portion 32 of oven range appliance 12 activated at step 810. If sensor 62 is proximate the heated portion 32 of oven range appliance 12 activated at step 810, method 800 proceeds to step 830 that corresponds to step 720 of method 700. Conversely, method 700 proceeds to step 840 if sensor 62 is not proximate the heated portion 32 of oven range appliance 12 activated at step 810. In such a manner, method 800 may avoid operating sensor fan 80 at the first power when sensor 62 is not proximate the heated portion 32 of oven range appliance 12 activated at step 810. From step 840, method 800 may proceed to step 740 or step 760 as described above for method 700.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A method for operating fans within a microwave appliance, the microwave appliance comprising a temperature sensor, a control panel, a control fan positioned adjacent the control panel, a microwave cabinet defining a duct, and an exhaust fan configured for drawing air through the duct, the temperature sensor contained with a sensor housing, sensor housing positioned at a bottom of the microwave cabinet and the sensor housing having a chamber contiguous with a portion of the duct at the bottom of the microwave cabinet, the sensor housing comprising a sensor fan configured for drawing air out of the duct of the microwave cabinet via the chamber of the sensor housing and urging the air towards a cooking surface of a range below the microwave cabinet, the temperature sensor positioned for monitoring the cooking surface below the microwave cabinet, the method comprising:

operating the sensor fan at a first power while the exhaust fan is deactivated;

activating the exhaust fan; and operating the sensor fan at a second power and activating the control fan after the exhaust fan is activated, the second power being different than the first power, the control fan and the sensor fan urging air out of the duct of the microwave cabinet via the chamber of the sensor housing while the sensor fan is operating at the second power and the control fan is activated.

2. The method of claim 1, further comprising receiving a temperature sensor activation signal prior to operating the sensor fan at the first power, wherein said step of operating the sensor fan at the first power comprises operating the sensor fan at the first power in response to receiving the temperature sensor activation signal while the exhaust fan is deactivated.

3. A method for operating fans within a microwave appliance, the microwave appliance comprising a temperature sensor, a control panel, a control fan positioned adjacent the control panel, a microwave cabinet defining a duct, and an exhaust fan configured for drawing air through the duct, the temperature sensor contained within a sensor housing, the sensor housing positioned at a bottom of the microwave cabinet and the sensor housing having a chamber contiguous with a portion of the duct at the bottom of the microwave cabinet, the sensor housing comprising a sensor fan configured for drawing air out of the duct of the microwave cabinet via the chamber of the sensor housing and urging the air towards a cooking surface of a range below the microwave cabinet, the temperature sensor positioned for monitoring the cooking surface below the microwave cabinet, the method comprising:

determining whether the sensor is positioned proximate a heating element on the cooking surface of the range in response to receiving a heating element activation signal from the range; and operating the sensor fan at a first power while the sensor is positioned proximate the heating element of the range or operating the sensor fan at a second power while the sensor is positioned proximate the heating element of the range and the exhaust fan is running, the second power being different than the first power, the sensor fan urging air out of the duct of the microwave cabinet via the chamber of the sensor housing while the sensor fan is operating.

4. The method of claim 3, further comprising deactivating the sensor fan in response to a temperature measurement from the temperature sensor being less than a temperature limit.

5. The method of claim 4, wherein said step of deactivating the sensor fan comprises deactivating the sensor fan in response to the temperature measurement from the temperature sensor being less than the temperature limit after a predetermined period of time from receiving a heating element deactivation signal from the range.

6. The method of claim 3, further comprising activating the control fan while the sensor is positioned proximate the heating element of the range and the exhaust fan is running, the control fan and the sensor fan urging air out of the duct of the cabinet via the chamber of the housing while the sensor fan is operating at the second power and the control fan is activated.

7. The method of claim 6, further comprising deactivating the sensor fan and the control fan in response to a temperature measurement from the temperature sensor being less than a temperature limit.

8. The method of claim 6, wherein said step of deactivating the sensor fan and the control fan comprises deactivating the sensor fan and the control fan in response to the temperature measurement from the temperature sensor being less than the temperature limit after a predetermined period of time from receiving a heating element deactivation signal from the range.

9. A method for operating fans within a microwave appliance, the microwave appliance comprising a temperature sensor, a control panel, a control fan positioned adjacent the control panel, a microwave cabinet defining a duct, and an exhaust fan configured for drawing air through the duct, the temperature sensor contained within a sensor housing, the sensor housing positioned at a bottom of the microwave cabinet and the sensor housing having a chamber contiguous with a portion of the duct at the bottom of the microwave cabinet, the housing comprising a sensor fan configured for drawing air out of the duct of the microwave cabinet via the chamber of the sensor housing and urging the air towards a cooking surface of a range below the microwave cabinet, the temperature sensor positioned for monitoring the cooking surface below the microwave cabinet, the method comprising:

operating the sensor fan at a first power in response to receiving a heating element activation signal from the range; and operating the sensor fan at a second power while the exhaust fan is running, the second power being different than the first power, the sensor fan urging air out of the duct of the microwave cabinet via the chamber of the sensor housing while the sensor fan is operating.

10. The method of claim 9, further comprising deactivating the sensor fan in response to a temperature measurement from the temperature sensor being less than a temperature limit.

11. The method of claim 10, wherein said step of deactivating the sensor fan comprises deactivating the sensor fan in response to the temperature measurement from the temperature sensor being less than the temperature limit after a predetermined period of time from receiving a heating element deactivation signal from the range.

12. The method of claim 9, further comprising activating the control fan while the exhaust fan is running, the control fan and the sensor fan urging air out of the duct of the cabinet via the chamber of the housing while the sensor fan is operating at the second power and the control fan is activated.

13. The method of claim 12, further comprising deactivating the sensor fan and the control fan in response to a temperature measurement from the temperature sensor being less than a temperature limit.

14. The method of claim 13, wherein said step of deactivating the sensor fan and the control fan comprises deactivating the sensor fan and the control fan in response to the temperature measurement from the temperature sensor being less than the temperature limit after a predetermined period of time from receiving a heating element deactivation signal from the range.

* * * * *